US006969237B2

(12) United States Patent
Hudson

(10) Patent No.: US 6,969,237 B2
(45) Date of Patent: Nov. 29, 2005

(54) TURBINE AIRFOIL COOLING FLOW PARTICLE SEPARATOR

(75) Inventor: Eric A. Hudson, Harwinton, CT (US)

(73) Assignee: United Technologies Corporation, Hartford, CT (US)

( * ) Notice: Subject to any disclaimer, the term of this patent is extended or adjusted under 35 U.S.C. 154(b) by 93 days.

(21) Appl. No.: 10/652,913

(22) Filed: Aug. 28, 2003

(65) Prior Publication Data

US 2005/0047902 A1 Mar. 3, 2005

(51) Int. Cl.[7] ..... F01D 5/14

(52) U.S. Cl. ..... 416/97 R; 416/231 R; 416/231 B

(58) Field of Search ..... 416/231 R, 231 B, 416/97 R

(56) References Cited

U.S. PATENT DOCUMENTS

| | | | | |
|---|---|---|---|---|
| 2,780,309 A | * | 2/1957 | Loftheim | 55/407 |
| 3,694,102 A | * | 9/1972 | Conrad | 415/115 |
| 3,720,045 A | * | 3/1973 | Murphy | 416/193 R |
| 3,993,463 A | | 11/1976 | Barr | |
| 4,098,594 A | * | 7/1978 | Shorr et al. | 55/403 |
| 4,292,050 A | | 9/1981 | Linhardt et al. | |
| 4,309,147 A | | 1/1982 | Koster et al. | |
| 4,527,387 A | | 7/1985 | Lastrina et al. | |
| 4,617,028 A | | 10/1986 | Ray et al. | |
| 4,685,942 A | | 8/1987 | Klassen et al. | |
| 4,702,071 A | | 10/1987 | Jenkins et al. | |
| 4,860,534 A | | 8/1989 | Easley et al. | |
| 4,928,480 A | | 5/1990 | Oliver et al. | |
| 5,139,545 A | | 8/1992 | Mann | |
| 5,224,819 A | * | 7/1993 | Kernon et al. | 415/115 |
| 5,370,499 A | * | 12/1994 | Lee | 416/97 R |
| 5,498,273 A | | 3/1996 | Mann | |
| 5,827,043 A | | 10/1998 | Fukuda et al. | |
| 6,134,874 A | | 10/2000 | Stoten | |

FOREIGN PATENT DOCUMENTS

| | | | | |
|---|---|---|---|---|
| EP | 416542 A1 | * | 4/1990 | F01D/5/18 |

* cited by examiner

*Primary Examiner*—Edward K. Look
(74) *Attorney, Agent, or Firm*—Bachman & LaPointe, P.C.

(57) ABSTRACT

A vane assembly for a turbine engine comprising a plurality of vanes each comprising a pressure side wherein the pressure side of at least one of the plurality of vanes comprises at least one opening extending through the pressure side into an interior portion of the at least one of the plurality of vanes.

11 Claims, 2 Drawing Sheets

TURBINE AIRFOIL COOLING FLOW PARTICLE SEPARATOR

U.S. GOVERNMENT RIGHTS

The invention was made with U.S. Government support under contract F33615-97-C-2779 awarded by the U.S. Air Force. The U.S. Government has certain rights in the invention.

BACKGROUND OF THE INVENTION (1) Field of the Invention

The present invention relates an inertial particle separator for cooling air provided to turbine blades.

(2) Description of the Related Art

Gas turbine engine design and construction requires ever increasing efficiency and performance. In order to achieve such increased efficiency and performance, often times the combustion component of the engine is modified such that exit temperatures are elevated. However, turbine airfoil temperature capability must be raised in such instances owing to the need for durability. In response to this need, various methods have been introduced to improve the cooling technology employed on turbine blades. These cooling schemes employ small holes and passages for cooling air flow. The most advanced cooling designs employ progressively smaller cooling features. Unfortunately, these small features are prone to plugging by dirt particulates. Such dirt particulates may derive from the external engine environment, fuel contaminates, less than filly burned fuel particulates, and other various sources of particulate matter. By clogging the cooling features, the dirt particulates result in the burning and oxidation of the airfoils.

What is therefore needed is a method for separating contaminating particles in order to improve the longevity of new technology air foil cooling schemes which make use of small internal cooling features. It is additionally necessary to improve and to decrease the incidence of airfoil cooling passage plugging present in existing designs.

SUMMARY OF THE INVENTION

Accordingly, it is an object of the present invention to provide an inertial particle separator for cooling air provided to turbine blades.

It is a further object of the present invention to provide a vane assembly for a turbine engine which comprises a plurality of vanes each comprising a pressure side wherein the pressure side of at least one of the plurality of vanes comprises at least one opening extending through the pressure side into an interior portion of the at least one of the plurality of vanes.

It is a further object of the present invention to provide a method for removing particles from engine airflow which comprises the steps of fabricating at least one opening through a pressure side of a vane passing airflow comprising contaminating particles across the pressure side of the vane, collecting the contaminating particles which pass through the at least one opening.

DETAILED DESCRIPTION

It is therefore the primary objective of the present invention to provide an inertial particle separator for cooling air provided to turbine blades. The object of the present invention is primarily achieved by adding one or more slots, or openings, to existing turning vanes of a size and orientation sufficient to capture and evacuate particles present within the airflow. As will be described more fully below, particles present in the airflow tend to travel along the pressure side of turning vanes. Depending on the size and the mass of the particles contained within the airflow, the inertia of the particles may be used to capture the particles as they impact upon the pressure side of the turning vane. By including a series of openings or slots in the wall of the airfoil, it is possible to capture a considerable percentage of particles as the airflow moves through the turning vanes.

Figure 1:
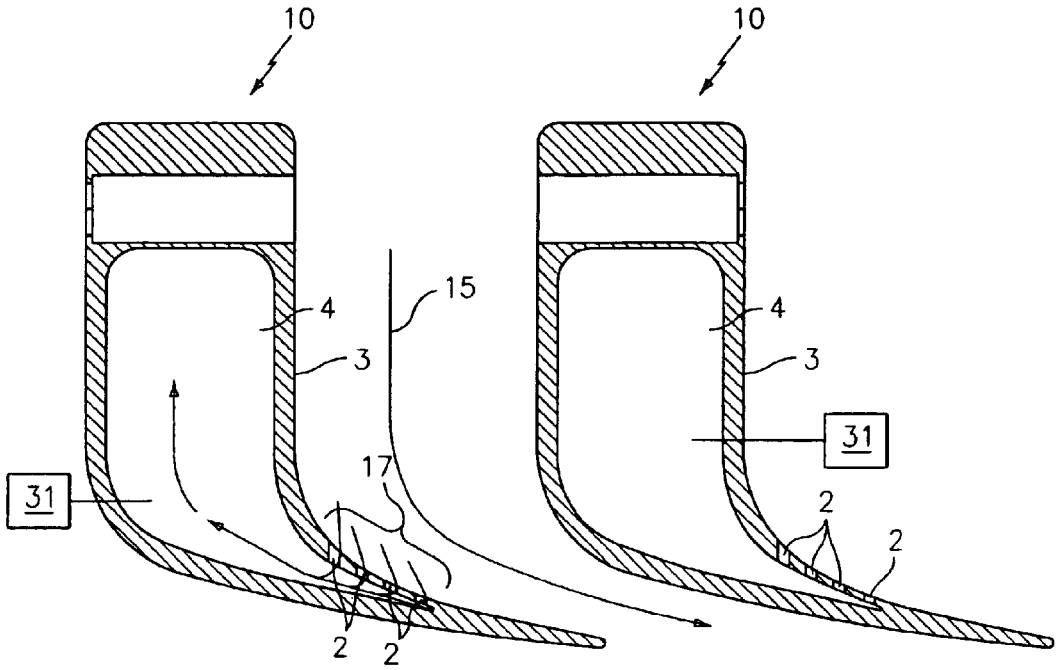
FIG. 1 is a diagram of the turning vanes of the present invention.

With reference to FIG. 1 there is illustrated a plurality of turning vanes 10 of the present invention. While illustrated with reference to the TOBI (Tangential Onboard Injection) system, the turning vanes of the present invention are no so limited. Rather, the present invention encompasses any and all vane utilized to reduce pressure losses and reduce the cooling air temperature of the cooling air supplied to the blades of an engine. As can be seen, turning vanes 10 are comprised of an interior cavity 4. An external edge of each turning vane 10 corresponds to the pressure side 3 of the turning vane. There is indicated airflow 15 which flows generally in a direction corresponding to pressure side 3. Note that a plurality of openings 2, or slots, have been fabricated into pressure side 3 commencing at a point at or after the turning area 17 of the vane 10. As used herein, "turning area" refers to the area of the vane located on the pressure side of the vane, starting at or near the point of maximum turn on the pressure side of the vane, and extending in the direction of airflow 15. Particles, embedded in airflow 15, may pass through the openings 2 and enter into the interior cavity 4. Due to their higher mass, dirt particles are less able to turn with the air molecules comprising airflow 15 and are concentrated on the pressure side 3 of the airflow. As a result, particles can be removed through openings 2. After passing through opening 2 and into interior cavity 4, the dirty air containing the dirt particles is passed through the interior cavity for venting to a venting location 31 less sensitive to dirt contamination. Venting location 31 is preferably maintained at a lower pressure than is interior cavity 4 in order to provide a suction force sufficient to draw the airflow required to conduct dirt particles from the main airflow stream.

Figure 2:
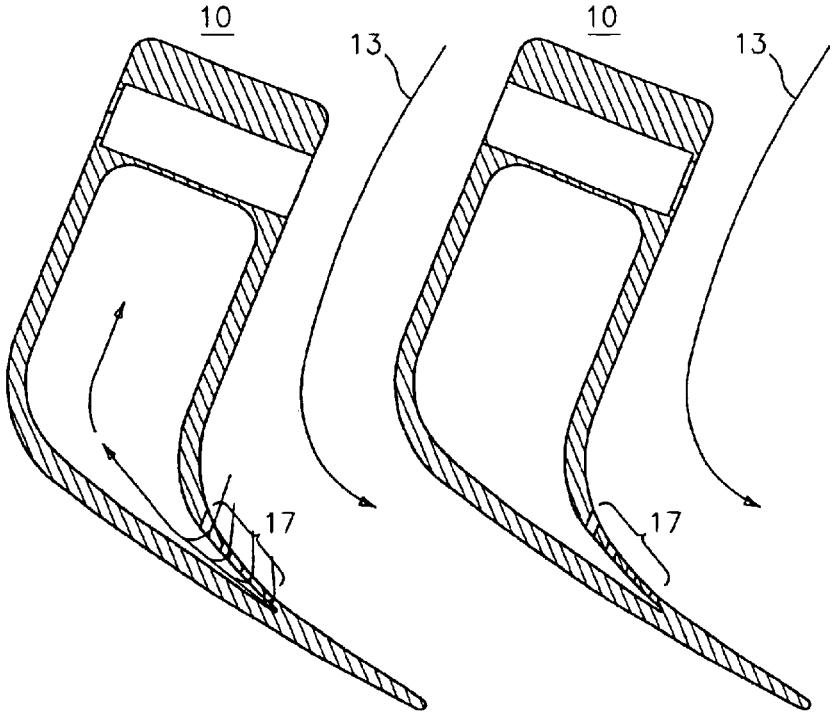
FIG. 2 is a diagram of the turning vanes of the present invention showing the increased turn gas flow direction.
Figure 3:
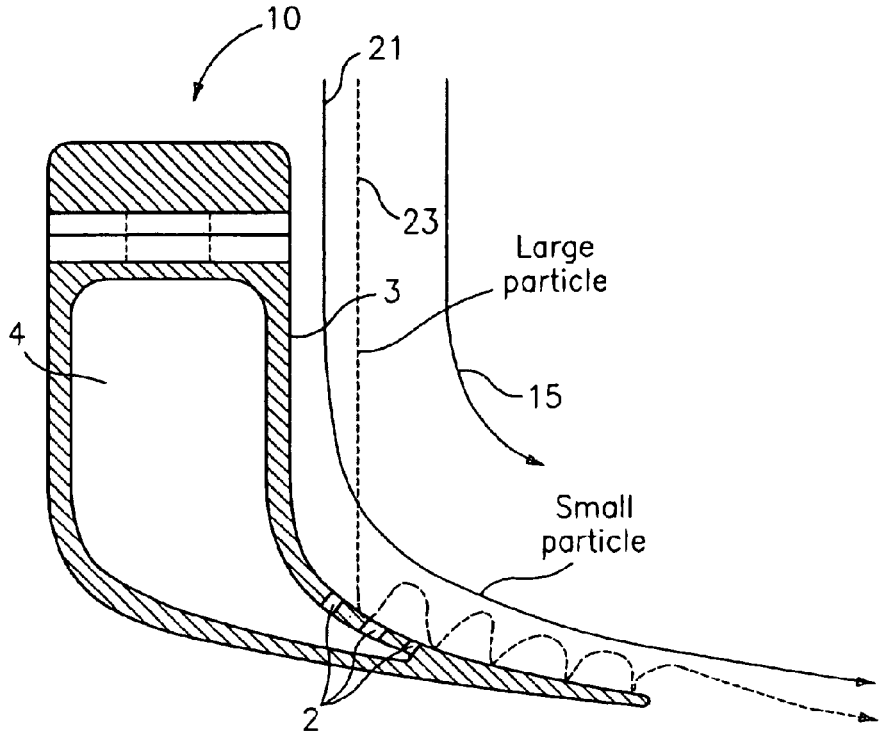
FIG. 3 is a diagram of the turning vanes of the present invention illustrating the path of exemplary large and small particles.

With reference to FIG. 3 there is illustrated the path of both relatively large particles and relatively small particles. Small particle path 21 represents the path followed by an exemplary small particle. Large particle path 23 represents the path followed by an exemplary large particle traveling in the general direction of airflow 15. Note that, because of the increased mass and inertia of the large particles traveling along the large particle path 23, the large particles impact pressure side 3 of turning vane 10 and proceed to bounce several times as they travel in the general direction of airflow 15. In contrast, small particles traveling along small particle path 21 tend, because of their smaller mass and lower inertia, to continue along with airflow 15 past turning vane 10. As is evident, because of the tendency for large particles to bounce several times as they move in correspondence with airflow 15, increasing the number of openings 2 to forming passage ways into interior cavity 4 increases the likelihood of capturing any given large particle. In order to increase the likelihood of capturing small particles traveling along small particle path 21, it is preferable to increase the degree of turning experienced by the small particles. With reference to FIG. 2, there is illustrated an increased turn gas flow direction 13 arises from rotating each of the plurality of turning vanes 10 so as to increase the maximum amount of turn present at a maximum turn area 17, and along increased turn gas flow direction 13. In a preferred embodiment, the openings are less than 1.5 millimeters as measured in the direction of airflow 15. Preferably, the total amount of pressure side 3 removed by the openings 2 is between 1% and 25%.

Figure 4:
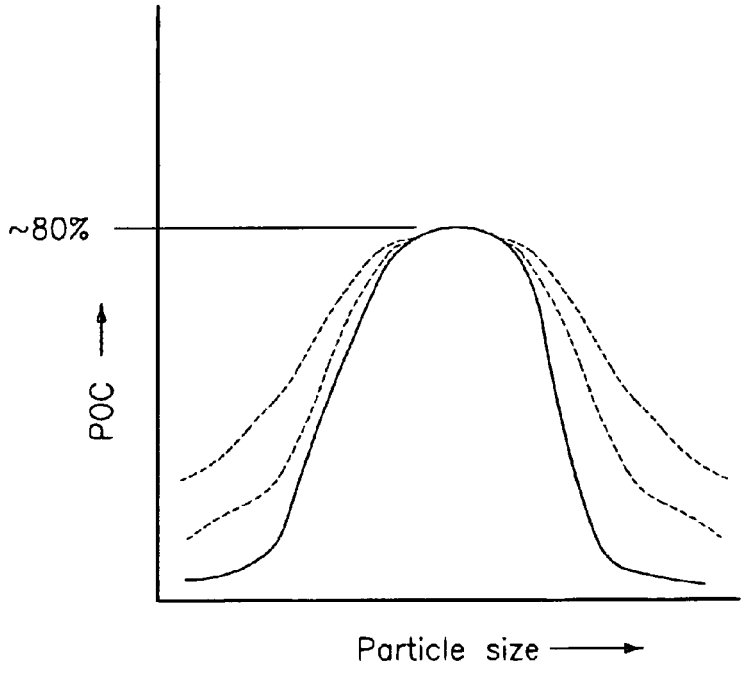
FIG. 4 is a graph illustrating the probability of capture as a function of particle size.

The aforementioned insights are graphically represented in FIG. 4. As is evident, the probability of capture, or "POC" as a function of particles size forms a generally Gaussian curve. That is to say, as the particle size approaches zero very few if any particles are captured and, additionally, as the particle size approaches a very large size, few large particles are captured. To the left hand side of the Gaussian curve there are two exemplary dotted curves drawn to illustrate the increasing likelihood of capturing particles of any particular small size by steadily increasing the turning angle of increased turn gas flow direction 13 as described above. Likewise, to the right hand side of the curve, there are two exemplary dotted graph lines drawn to show the increased likelihood of capturing large particles as a result of increasing number slots.

It is apparent that there has been provided in accordance with the present invention an inertial particle separator for cooling air provided to turbine blades which fully satisfies the objects, means, and advantages set forth previously herein. While the present invention has been described in the context of specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is claimed is:

1. A particle separator for a turbine engine comprising:

a plurality of stationary vanes each comprising a pressure side wherein said pressure side of at least one of said plurality of vanes comprises at least one aperture flush with and extending through said pressure side into an interior portion of said at least one of said plurality of vanes.

2. The particle separator of claim 1, wherein each of said at least one opening comprises a diameter less than 1.5 millimeters.

3. The particle separator of claim 1, wherein between 1% and 25% of said pressure side is covered by said at least one opening.

4. The particle separator of claim 1, wherein at least one of said at least one opening is formed by a slot.

5. The particle separator of claim 1, wherein said plurality of vanes comprise turbine engine turning vanes.

6. A method for removing particles from engine airflow comprising the steps of:

providing at least one aperture through a pressure side of a stationary vane;

passing airflow containing contaminating particles across said pressure side of said stationary vane;

drawing said airflow containing said contaminating particles through said at least one aperture at a first pressure; and collecting said contaminating particles which pass through said at least one aperture.

7. The method of claim 6, wherein collecting said contaminating particles comprises the steps of:

receiving said contaminating particles in an interior cavity at said first pressure; and moving said contaminating particles from said interior cavity to a venting location at a second pressure.

8. The method of claim 7, wherein the first pressure is greater than the second pressure.

9. The method of claim 6, further comprising the steps of:

passing said airflow containing contaminating particles along a trailing edge of said pressure side approximate to a turning area; and drawing said airflow containing contaminating particles back towards a leading edge of said pressure side after said airflow is drawn through said at least one aperture.

10. The method of claim 6, further comprising the steps of:

passing said airflow containing contaminating particles into a turning area approximate to a trailing edge of said pressure side; and drawing said airflow containing contaminating particles back towards a leading edge of said pressure side after said airflow is drawn through said at least one aperture.

11. The method of claim 6, further comprising the steps of:

drawing said airflow containing contaminating particles into a turning area approximate to a trailing edge of said pressure side; and directing said airflow containing contaminating particles back towards a leading edge of said pressure side after said airflow is drawn through said at least one aperture.

* * * * *